US007281359B2

(12) United States Patent
Marshall

(10) Patent No.: US 7,281,359 B2
(45) Date of Patent: Oct. 16, 2007

(54) SPACER AND METHOD OF USE FOR STRAIGHTENING PANELS IN A ROOF SYSTEM

(76) Inventor: Joe Marshall, 107 Melrose Street, Rathwell, Manitoba (CA) R0G 1S0

( * ) Notice: Subject to any disclaimer, the term of this patent is extended or adjusted under 35 U.S.C. 154(b) by 279 days.

(21) Appl. No.: 10/864,452

(22) Filed: Jun. 10, 2004

(65) Prior Publication Data

US 2005/0204674 A1 Sep. 22, 2005

(30) Foreign Application Priority Data

Feb. 25, 2004 (CA) ..... 2458900

(51) Int. Cl.
*E04B 1/38* (2006.01)

(52) U.S. Cl. ..... 52/712; 52/714; 52/545; 52/547; 52/544; 24/295; 24/294; 24/546

(58) Field of Classification Search ..... 52/712, 52/545, 484, 506, 543, 544; 24/295, 294, 24/546, 712, 714, 458
See application file for complete search history.

(56) References Cited

U.S. PATENT DOCUMENTS

D156,659 S * 12/1949 Reed ..... D8/395
3,998,019 A * 12/1976 Reinwall, Jr. ..... 52/478
4,296,581 A 10/1981 Heckelsberg
4,423,581 A 1/1984 Miller
4,522,005 A * 6/1985 Seaburg et al. ..... 52/544
4,575,983 A 3/1986 Lott, Jr. et al.
4,873,808 A 10/1989 Heisey, Jr. et al.
D318,608 S * 7/1991 Schenker ..... D8/382
5,193,321 A * 3/1993 Edwards ..... 52/466

* cited by examiner

*Primary Examiner*—Jeanette Chapman
*Assistant Examiner*—Dan Kenny
(74) *Attorney, Agent, or Firm*—Ryan W. Dupuis; Michael R. Williams; Adrian D. Battison

(57) ABSTRACT

A spacer is provided for use in a standing seam roof system in which roof panels are provided having a base portion and upstanding side flanges along opposed longitudinal sides of the panel. The panels are installed sequentially along roof purlins in a working direction. Occasionally a portion of each panel being installed trails in the working direction in relation to the remainder of the panel. A spacer element is provided with a hook for being suspended in the seam between upstanding side flanges of adjacent panels to advance the trailing portion of the panels and thereby straighten the panels of the roof system.

19 Claims, 4 Drawing Sheets

SPACER AND METHOD OF USE FOR STRAIGHTENING PANELS IN A ROOF SYSTEM

This application claims foreign priority benefits from Canadian Patent Application 2,458,900 filed Feb. 25, 2004.

1. Field of the Invention

The present invention relates to a spacer and method of use for straightening panels in a standing seam roof system.

2. Background

Standing seam roof panels form a known type of roof system in which the elongate panels span across a plurality of horizontal purlins which extend parallel to the peak of the roof at spaced positions therefrom towards the lower edges of the roof. The roof panels typically include a flat base portion with upstanding side flanges extending along opposing longitudinal edges of the panel. Mounting clips are secured to the purlins at spaced positions therealong for securement within the seam between upstanding side flanges of adjacent panels. The panels are typically installed along a roof by advancing along the purlins in a working direction with the panels being sequentially secured to the purlins using the mounting clips. The upstanding side flanges are not always consistent in their vertical orientation relative to the base portion such that when the panels are installed while advancing in the working direction, the panels tend to become misaligned and no longer parallel with other panels already installed on the roof such that each new panel being installed includes a trailing portion which falls behind in the working direction in relation to the remaining portion of the panel. In order to straighten the panels, the mounting clips are typically twisted or installed off centre from the seam to cause some distortion to the panel to advance the trailing portion in the working direction so that the panels may again be parallel. The known methods of varying the mounting clips tends to result in over or under compensating advancement of the trailing portion causing further distortion of the roof panels. Furthermore variation of the mounting clips by twisting or mounting offset from the seam causes the seam to rest poorly on the purlins and causes folding at the seam to be unnecessarily difficult.

SUMMARY

According to one aspect of the present invention there is provided a spacer for a roof system comprising elongate panels each having a base portion and upstanding side flanges along opposing longitudinal edges of the panel, the panels spanning roof purlins in a side by side configuration for securement to the purlins by mounting clips fastened to the purlins, each mounting clip including an upstanding mounting portion for being secured in a seam formed between the upstanding side flanges of a respective adjacent pair of the panels, the spacer comprising:

a spacer element; and a hook for suspending the spacer element between the upstanding side flanges of an adjacent pair of the panels.

According to a second aspect of the present invention there is provided a method of straightening panels in a roof system comprising elongate panels each having a base portion and upstanding side flanges along opposing longitudinal edges of the panel, the panels spanning roof purlins in a side by side configuration for securement to the purlins by mounting clips fastened to the purlins, each mounting clip including an upstanding mounting portion for being secured in a seam formed between the upstanding side flanges of a respective adjacent pair of the panels, the method comprising:

providing spacer elements, each having a hook for suspending the spacer element between the upstanding side flanges of an adjacent pair of the panels; and suspending the spacer elements at spaced positions along a portion of the seam between the upstanding side flanges of adjacent ones of the panels as the panels are installed on the purlins when the panels are misaligned.

The use of spacer clips permits advancement of the trailing portion of the panels to be compensated for gradually over a series of consecutive rows resulting in minimal distortion of the panels without any considerable inconvenience to the task of folding a seam. The use of the spacer according to the present invention, allows a foreman on a job site to be in control of the positioning of the panels. By measuring the newly installed panels at various positions along the length relative to a starting or finishing edge of the roof, it can be determined if one portion is trailing, and the trailing portion can readily be remedied by supplying a worker in that area with a limited number of spacers. The limited number of spacers provides a minimum spacing without the likelihood to overcompensate and accordingly when the worker runs out of spacers, continued overcompensation of advancing the trailing portion does not continue as in past attempts to straighten the roof by simply distorting the mounting clips. Accordingly better control of the quality of the roof is achieved.

In a roof system in which the upstanding side flanges of the panels include a lateral flange at a free end thereof for being folded into the respective seam, the hook preferably includes a main portion supporting the spacer element thereon and a free end portion spaced from the main portion for receiving the lateral flange therebetween.

The spacer element may project substantially perpendicularly from a body portion of the spacer which spans between the spacer element and the hook.

The hook and the spacer element may be integrally formed of a single sheet of material which has been folded.

The spacer element is preferably wedge shaped having increasing thickness with increasing distance from the hook, accordingly the spacer element is narrowest adjacent the hook.

Height of the spacer between the hook and the spacer element may be between approximately 1 and 3 inches for accommodating most standard roof panel sizes, however a height of approximately 1½ inches is preferred.

The hook may include a main portion supporting the spacer element thereon and a free end portion spaced from the main portion between approximately ⅛ inch and 1½ inches for receiving an upstanding side flange of a typical sized roof panel therebetween. A spacing of approximately 1 inch is preferred.

When the spacer is in combination with said roof system, height of the spacer between the hook and the spacer element is preferably less that a height of the upstanding side flanges.

The spacers are preferably supported at spaced positions along the seams between respective ones of the mounting clips.

The hook is preferably folded into the seam between the upstanding flanges of adjacent ones of the panels.

When installing the panels sequentially along the purlins in a working direction, the spacer elements are preferably suspended between the upstanding side flanges of adjacent panels when the panels are trailing in the working along a trailing portion thereof in relation to a remainder of the panels, the spacer elements only being suspended along said trailing portion of the panels.

The spacer elements may be suspended along the trailing portion of plural consecutive panels to straighten the panels.

BRIEF DESCRIPTION OF THE DRAWINGS

In the accompanying drawings, which illustrate exemplary embodiments of the present invention.

DETAILED DESCRIPTION

Figure 1:
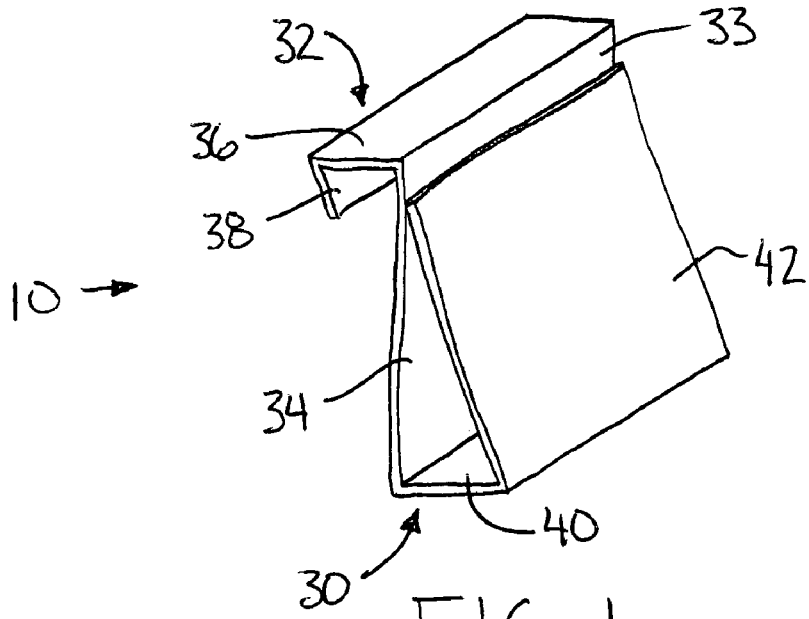
FIG. 1 is a perspective view of the spacer.
Figure 2:
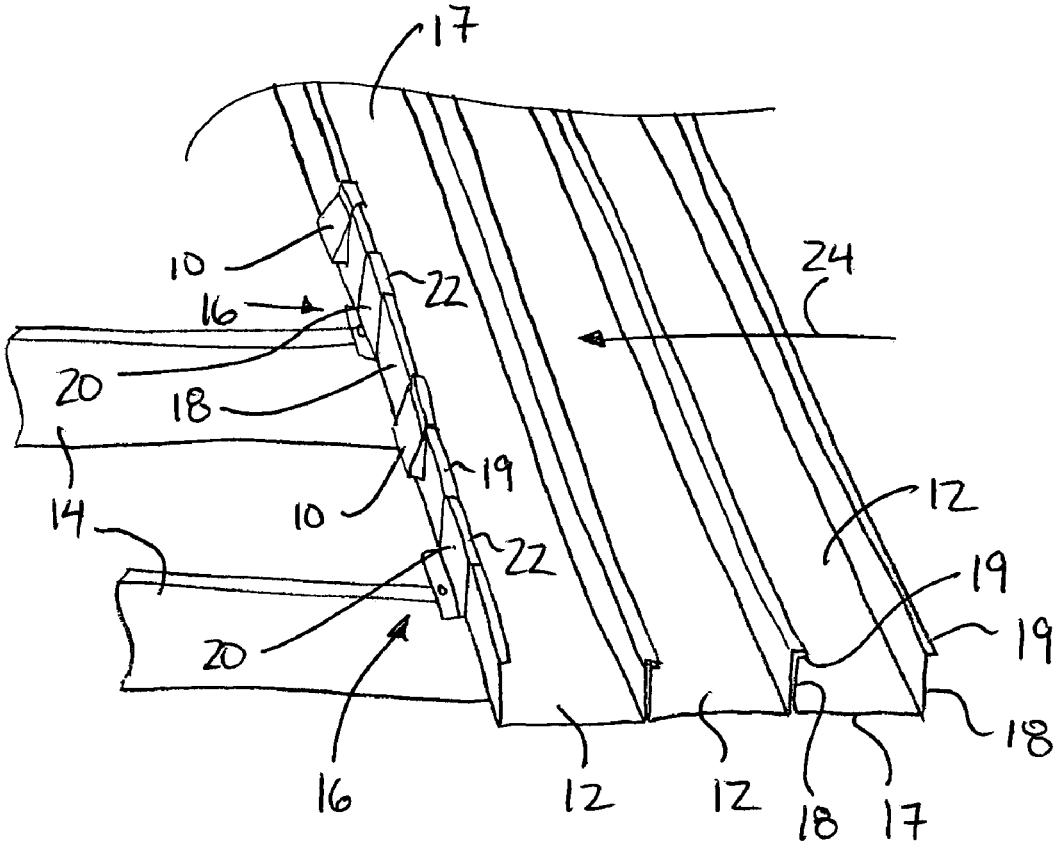
FIG. 2 is a perspective view of a roof system using standing seam panels.
Figure 3:
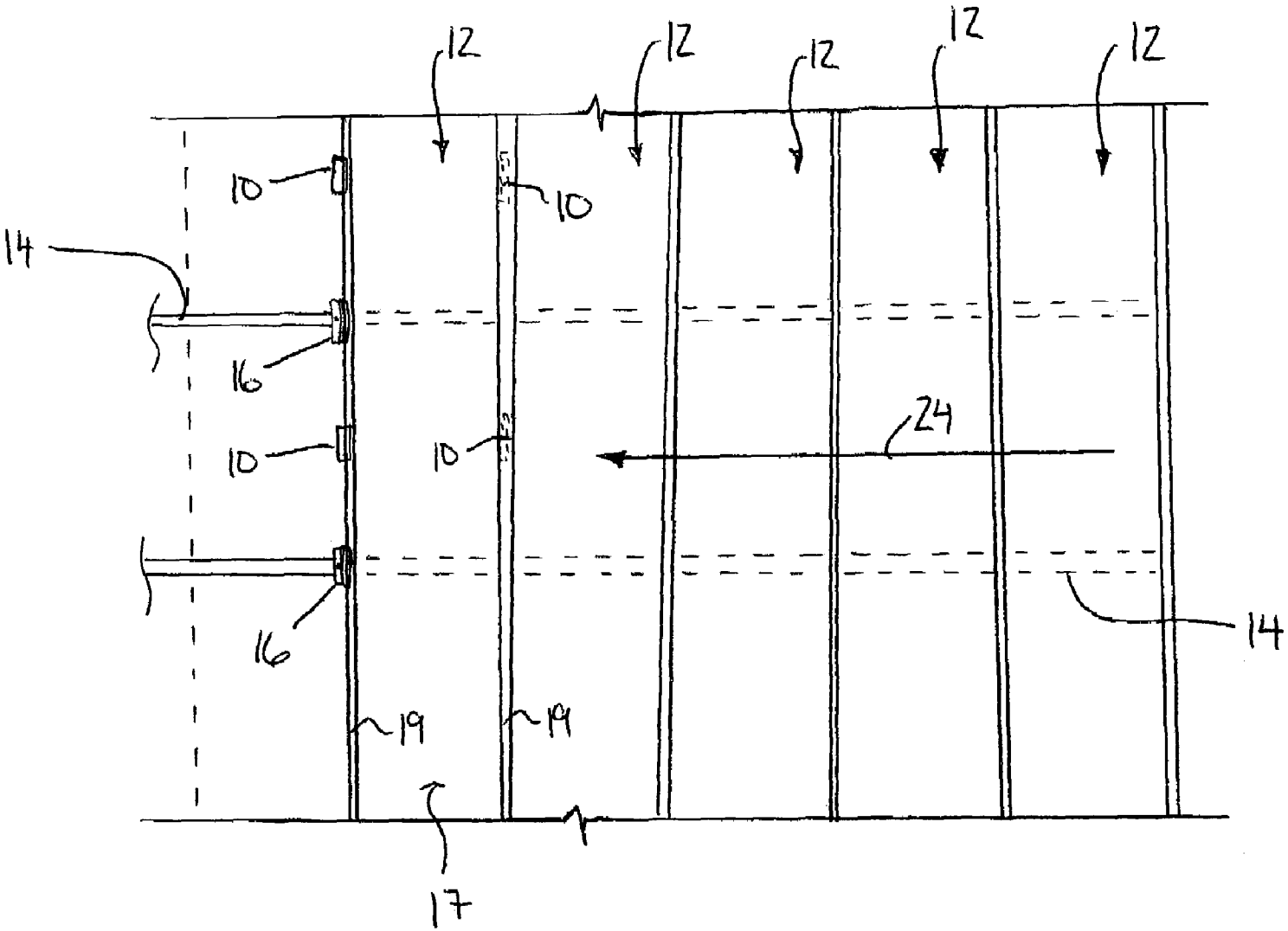
FIG. 3 is a top plan view of the roof system according to FIG. 2 illustrating spacers installed therein.

Referring to the accompanying drawings, there is illustrated a spacer generally indicated by reference numeral 10. The spacer is particularly suited for use in a roof system using standing seam panels 12 which are supported on purlins 14 by mounting clips 16 secured to the purlins and folded within the seam between adjacent panels 12.

Each panel 12 includes a generally horizontal base portion 17 and upstanding side flanges 18 extending along opposing longitudinal edges of the panel. A free end of each upstanding side flange includes a lateral flange 19 lying substantially parallel to the base portion 17. The lateral flanges 19 project in the same direction such that one of the flanges projects inwardly and the opposing flange projects outwardly whereby the outward projecting lateral flange is permitted to overlap the inward projecting lateral flange of an adjacent panel of similar configuration when the panels are laid across the purlins of the roof.

Each mounting clip includes an upstanding portion 20 having a lateral flange 22 thereon for being overlapped between the flanges of adjacent panels at a seam therebetween. The lateral flanges 22 are folded together with the mounting clips secured therein to form the seam between adjacent panels. The panels are sequentially mounted across the purlins in a side-by-side configuration by advancing along the purlins in a working direction 24 parallel to the purlins. After installation of each panel, mounting clips are secured to the purlins along the free edge of the last panel overtop of which the next panel is overlapped before the seam is folded and a subsequent panel is ready to be installed. In the illustrated embodiment a layer of insulation 26 is provided between the panels and the purlins. The mounting clips 16 in this instance are secured to the purlins through the insulation.

While various embodiments of the spacer are shown in the drawings, the common features of each will first be described herein. The spacer 10 includes a spacer element 30 which is received between the upstanding side flanges 18 of adjacent panels to provide a space therebetween as desired. The spacer element 30 is connected to a hook 32 of the spacer which suspends the spacer element from the lateral flanges at the seam.

The hook 32 includes a main portion 33 which is formed continuous with a vertical body portion 34 of the spacer. A lateral portion 36 of the hook projects from the main portion 33 at a top end thereof in a first perpendicular direction to the body portion 34. A free end portion 38 depends from the lateral portion 36 spaced from the main portion 33 sufficiently for receiving the lateral flanges 19 of the panels therein. The free end portion 38 extends downwardly at an inward incline towards the body portion 34 of the spacer. Accordingly the hook has a generally inverted U-shaped configuration.

The spacer element comprises a spacer flange 40 supported at the bottom end of the body portion 34 of the spacer to extend in a second perpendicular direction opposite the hook a distance of the spacing provided by the spacer. The spacer element includes a wedge which spans the free end of the spacer flange 40 to the body portion 34 adjacent the hook. Accordingly the wedge 42 increases in width with increasing distance from a narrowest part of the wedge 42 adjacent to the hook.

Figure 6:
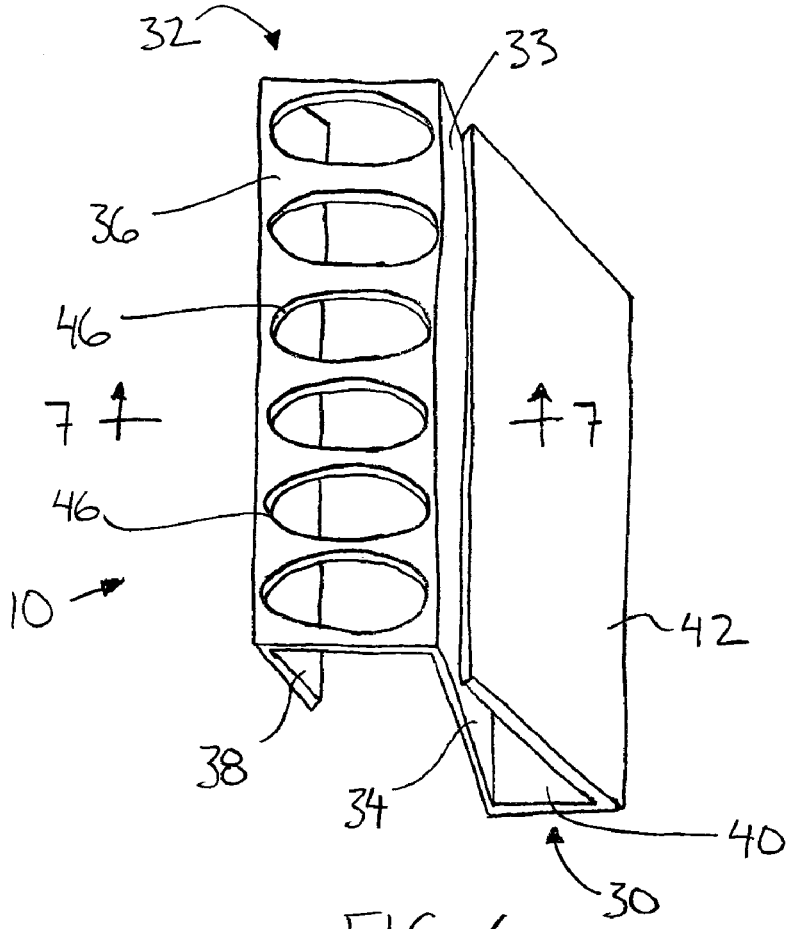
FIG. 6 is a perspective view of a further embodiment of the spacer.

Turning now to the embodiment of FIG. 6, the spacer 10 is identical to the embodiment of FIG. 1 except for the addition of sealant apertures 46 being located in the lateral portion 36 of the hook. A plurality of the sealant apertures 46 are provided so as so be sequentially located adjacent one another with a minimal gap of material preferably in the order of ⅛ inch between each adjacent pair of apertures. Each aperture 46 substantially spans the width of the lateral flange 36. When the hook of the spacer is folded into the seam between lateral flanges of adjacent roof panels, any sealant material 48, typically in the form of a strip of butyl, which is applied between the lateral flanges of adjacent panels, is permitted to ooze through the apertures 46 for fully surrounding the lateral portion 36 of the hook, thereby sealing between the lateral flanges of the roof panels even at the spacer 10.

The spacer 10 is formed of a single sheet of material which has been suitably folded to define the hook and the wedge of the spacer element. In the illustrated embodiments, a sheet of material which is approximately one and a half inches in width and four or five inches in length is suitable to define a spacer which is approximately one and a half inches in height between the hook and the spacer flange with the free portion of the hook being spaced from the main portion of the hook by approximately half an inch. The spacer flange in this arrangement is also approximately half an inch with the wedge tapering to thickness of the sheet metal used to fold the spacer adjacent the hook at the top of the body portion 34 of the spacer. In further embodiments, the spacer preferably has a height between 1 and 3 inches, a spacing between the free end portion and the main portion of the hook between ⅛ inch and 1½ inches, a spacer flange spanning ¼ inch to 1½ inches, a free end portion of the hook between ¼ inch and 1 inch, and a width between 1 and 5 inches.

When installing the roof panels in the working direction from a starting edge of the roof to a finishing edge along the purlins in a sequential side-by-side configuration, the orientation of the panels are periodically checked to determine if the edges of the last panel installed are parallel to the starting and finishing edges of the roof. When a portion of the last installed panel is misaligned so as to extend at a slight inclination in relation to the remaining panels, the spacers 10 are installed in the seam only at the trailing portion to advance the next panels installed at the trailing portion in the working direction whereby the newly installed panels are straightened in relation to the starting and finishing edges.

Spacers are typically installed in plural consecutive rows along respective consecutively installed panels until all portions of the panel which is next being installed is substantially parallel to the starting and finishing edges of the roof.

Figure 5:
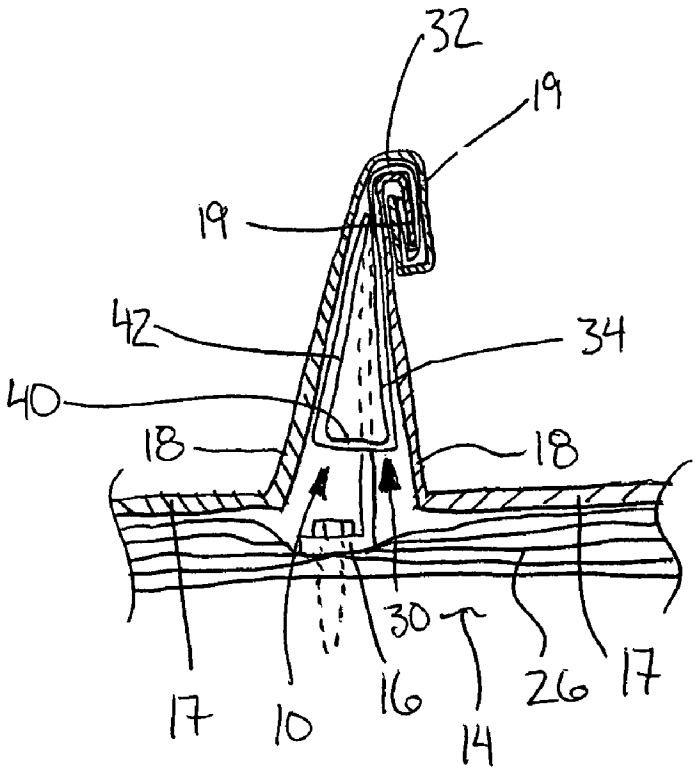
FIG. 5 is a sectional view of a completed folded seam.
Figure 4:
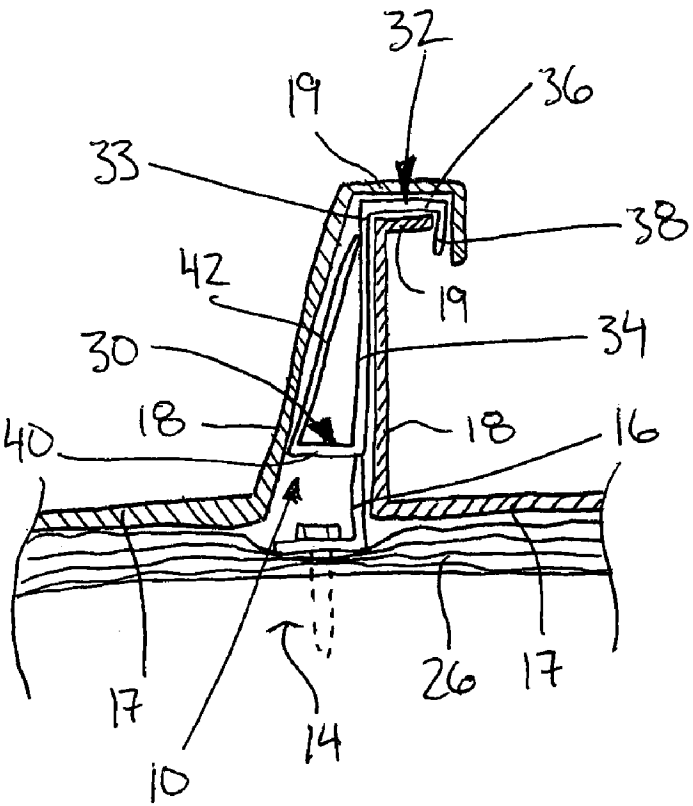
FIG. 4 is a sectional view of a spacer at the seam before the seam is folded.
Figure 7:
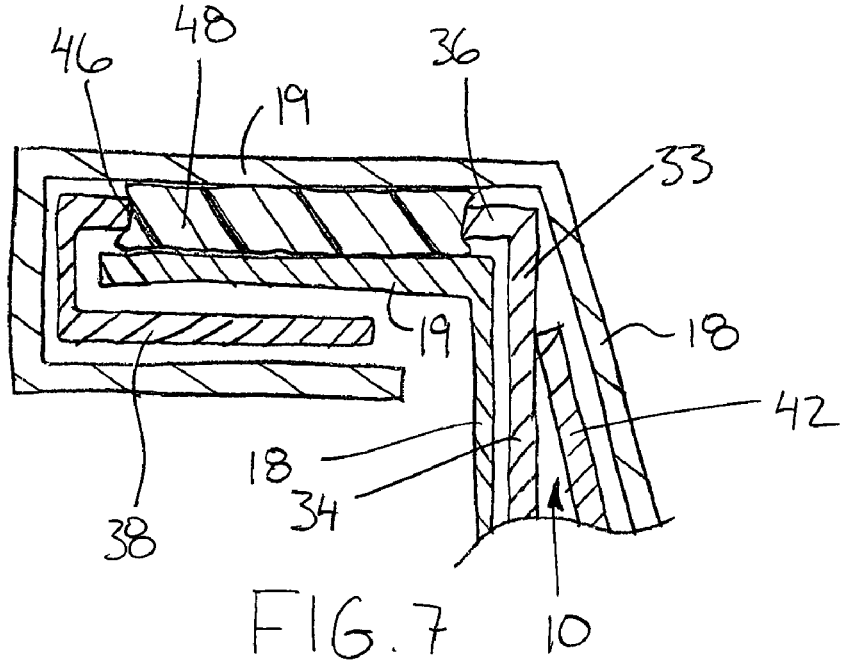
FIG. 7 is a sectional view along the line 7-7 of FIG. 6 once installed in a standing seam of the roof system.

Each spacer is installed by extending the hook 32 over the lateral flange at the free edge of the last installed panel. The spacers are installed at spaced positions along the trailing portion of the panel between respective ones of the mounting clips before the next adjacent panel is installed so that its lateral flange overlaps the lateral flange of the previously installed panel. Typically, sealant 48 is inserted as a strip of butyl or caulking between the lateral flanges of adjacent roof panels as they are overlapped as shown in FIG. 7. Accordingly the spacer is received between the upstanding side flanges of the adjacent panels with the hook being overlapped between the lateral flanges of the adjacent panels so that sealant material 48 passes through the sealant apertures to fully seal between the lateral flanges at the spacer. The spacers and mounting clips are secured in the seam between the lateral flanges by first turning the free end portion of the hook upwardly against the underside of the lateral flanges. The lateral flanges at the hook folded therein are again folded so as to subsequently lie flat against the abutted upstanding side flanges of the adjacent panels to form the completed seam as illustrated in FIG. 5 in which the base portions of adjacent panels are held spaced apart by the spacer to advance a portion of the panels. Accordingly the panels are straightened and aligned.

While some embodiments of the present invention have been described in the foregoing, it is to be understood that other embodiments are possible within the scope of the invention. The invention is to be considered limited solely by the scope of the appended claims.

The invention claimed is:

1. A spacer in combination with a roof system, the roof system comprising:

a plurality of roof purlins;

elongate panels each having a base portion and upstanding side flanges along opposing longitudinal edges of the panel, the panels spanning across the roof purlins in a side by side configuration; and a plurality of mounting clips fastened to the roof purlins and securing the panels to the roof purlins, each mounting clip including an upstanding mounting portion for being secured in a seam formed between the upstanding side flanges of a respective adjacent pair of the panels;

the spacer comprising:

a spacer element arranged to support the base portions of an adjacent pair of the panels spaced apart from one another; and a hook suspending the spacer element therebelow to be located directly between the upstanding side flanges of the adjacent pair of the panels;

the spacer element forming a wedge, between the side flanges, having increasing thickness with increasing distance from the hook.

2. The combination according to claim 1 wherein height of the spacer between the hook and the spacer element is less than a height of the upstanding side flanges.

3. The combination according to claim 1 wherein the hook is folded into the seam between the upstanding flanges of adjacent ones of the panels.

4. The combination according to claim 1 wherein the spacer element is suspended between the upstanding side flanges of adjacent panels where the panels are trailing in a working direction of installation in relation to a remainder of the panels.

5. The combination according to claim 4 wherein there is provided a plurality of spacer elements, each being suspended between a respectively pair of adjacent panels.

6. The combination according to claim 1 wherein there is provided a plurality of spacer elements supported at spaced positions along the seams between respective ones of the mounting clips.

7. The combination according to claim 1 wherein the spacer element is narrowest adjacent the hook.

8. The combination according to claim 1 wherein the hook and the spacer element are integrally formed of a single, folded sheet of material.

9. The combination according to claim 1 wherein the upstanding side flanges of the panels include a lateral flange at a free end thereof which is folded into the respective seam and wherein the hook includes a main portion supporting the spacer element thereon and a free end portion spaced from the main portion in which the lateral flange is received therebetween.

10. A spacer in combination with a root system, the roof system comprising:

a plurality of roof purlins;

elongate panels each having a base portion and upstanding side flanges along opposing longitudinal edges of the panel, the panels spanning across the roof purlins in a side by side configuration; and a plurality of mounting clips fastened to the roof purlins and securing the panels to the roof purlins, each mounting clip including an upstanding mounting portion for being secured in a seam formed between the upstanding side flanges of a respective adjacent pair of the panels;

the spacer comprising:

a spacer element arranged to support the base portions of an adjacent pair of the panels spaced apart from one another; and a hook in the seam between the upstanding side flanges of the adjacent pair of the panels and suspending the spacer element therebelow;

wherein height of the spacer between the hook and the spacer element is less than a height of the upstanding side flanges such that the spacer element is suspended only between the upstanding side flanges of the adjacent pair of the panels.

11. The combination according to claim 10 wherein the spacer element forms a wedge having increasing thickness with increasing distance from the hook.

12. The combination according to claim 10 wherein the spacer element is narrowest adjacent the hook.

13. The combination according to claim 10 wherein the hook and the spacer element are integrally formed of a single, folded sheet of material.

14. The combination according to claim 10 wherein the spacer element is suspended between the upstanding side flanges of adjacent panels where the panels are trailing in a working direction of installation in relation to a remainder of the panels.

15. A plurality of spacers in combination with a roof system, the roof system comprising:

a plurality of roof purlins;

elongate panels each having a base portion and upstanding side flanges along opposing longitudinal edges of the panel, the panels spanning across the roof purlins in a side by side configuration; and a plurality of mounting clips, each fastened to the roof purlins and securing the panels to the roof purlins, each mounting clip including an upstanding mounting portion for being secured in a seam formed between the upstanding side flanges of a respective adjacent pair of the panels;

each spacer comprising:

a spacer element arranged to support the base portions of an adjacent pair of the panels spaced apart from one another; and a hook suspending the spacer element between the upstanding side flanges of the adjacent pair of the panels;

the spacer elements being supported along the seams at spaced positions between respective ones of the mounting clips fastened to the purlins.

16. The combination according to claim 15 wherein the spacer element forms a wedge having increasing thickness with increasing distance from the hook.

17. The combination according to claim 15 wherein the spacer element is narrowest adjacent the hook.

18. The combination according to claim 15 wherein the hook and the spacer element are integrally formed of a single, folded sheet of material.

19. The combination according to claim 15 wherein the spacer element is suspended between the upstanding side flanges of adjacent panels where the panels are trailing in a working direction of installation in relation to a remainder of the panels.

* * * * *